US012285069B2

(12) United States Patent
Teetzel et al.

(10) Patent No.: US 12,285,069 B2
(45) Date of Patent: Apr. 29, 2025

(54) HELMET ACCESSORY SYSTEM

(71) Applicant: WILCOX INDUSTRIES CORP., Newington, NH (US)

(72) Inventors: James W. Teetzel, Portsmouth, NH (US); Elliott S. Turner, Newmarket, NH (US); Mathew A. Reichl, Portsmouth, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 18/500,657

(22) Filed: Nov. 2, 2023

(65) Prior Publication Data

US 2024/0164464 A1 May 23, 2024

Related U.S. Application Data

(60) Provisional application No. 63/427,496, filed on Nov. 23, 2022.

(51) Int. Cl.
*A42B 3/04* (2006.01)

(52) U.S. Cl.
CPC ..... *A42B 3/0406* (2013.01)

(58) Field of Classification Search
CPC ..... A42B 3/04; A42B 3/0406; A42B 3/30
See application file for complete search history.

(56) References Cited

U.S. PATENT DOCUMENTS

| | | | |
|---|---|---|---|
| 7,219,370 | B1 | 5/2007 | Teetzel et al. |
| 8,531,592 | B2 | 9/2013 | Teetzel et al. |
| 8,826,463 | B2 | 9/2014 | Teetzel et al. |
| 8,984,665 | B2 | 3/2015 | Celona et al. |
| 9,113,129 | B2 | 8/2015 | Teetzel et al. |
| 10,928,163 | B2 | 2/2021 | Zimmer |
| 11,330,857 | B2 | 5/2022 | Teetzel et al. |
| 11,419,382 | B2 | 8/2022 | Teetzel et al. |
| 11,612,207 | B2 | 3/2023 | Teetzel et al. |
| 2017/0205202 | A1 | 7/2017 | Teetzel et al. |
| 2019/0101359 | A1* | 4/2019 | Zimmer ..... A42B 3/306 |

(Continued)

FOREIGN PATENT DOCUMENTS

WO 2020237189 A1 11/2020

OTHER PUBLICATIONS

Extended European Search Report dated May 7, 2024, received in European Patent Application No. EP23208481.4.

*Primary Examiner* — Jillian K Pierorazio
(74) *Attorney, Agent, or Firm* — McLane Middleton, Professional Association

(57) ABSTRACT

A helmet accessory system comprises first and second ear brackets, for attachment to a helmet, having a side shroud housing for securing to the side of the helmet and an extension portion curving toward the rear of the helmet. The extension portions enclose circuitry electrically coupled to first sets of electrical contacts on the ear brackets and second sets of electrical contacts on the extension portion. An electrical hot shoe mounting member disposed on the rear portion of the helmet is configured for electrical communication with a helmet power and data circuit. A hot shoe adapter bridge for detachably and electrically coupling to the electrical hot shoe mounting member is operable to couple first and second ear brackets to the helmet power and data circuit.

15 Claims, 9 Drawing Sheets

(56) References Cited

U.S. PATENT DOCUMENTS

| | | | | |
|---|---|---|---|---|
| 2019/0104797 | A1* | 4/2019 | Teetzel | F41H 1/04 |
| 2019/0208854 | A1* | 7/2019 | Teetzel | A42B 3/0433 |
| 2019/0386412 | A1* | 12/2019 | Goupil | H01R 33/765 |
| 2020/0225488 | A1* | 7/2020 | Goupil | G02B 27/0172 |
| 2021/0315314 | A1* | 10/2021 | Teetzel | A42B 3/30 |
| 2022/0071336 | A1* | 3/2022 | Franzino | A42B 3/04 |
| 2022/0408869 | A1* | 12/2022 | Franzino | H02J 7/0044 |
| 2024/0204328 | A1 | 6/2024 | Teetzel et al. | |
| 2024/0255257 | A1 | 8/2024 | Teetzel et al. | |

* cited by examiner

HELMET ACCESSORY SYSTEM

CROSS-REFERENCE TO RELATED APPLICATION

This application claims the priority benefit of U.S. provisional application No. 63/427,496 filed Nov. 23, 2022. The aforementioned application is incorporated here by reference in its entirety.

BACKGROUND

The present invention relates to helmet accessory mounting systems and, in particular, to a universal helmet mounting assembly with power distribution.

SUMMARY

In one aspect, a modular helmet accessory system comprises a first ear bracket configured for attachment to a first side of a helmet and a second ear bracket configured for attachment to a second side of the helmet opposite the first side of the helmet. The first ear bracket has a first side shroud housing configured to be secured to the first side of the helmet and a first extension portion configured to curve around an exterior of the helmet toward a rear portion of the helmet. The first extension portion is configured to enclose first circuitry which is electrically coupled to a first set of electrical contacts disposed on the first ear bracket and a second of electrical contacts disposed on a distal end of the first extension portion. The second ear bracket has a second side shroud housing configured to be secured to the second side of the helmet and a second extension portion configured to curve around the exterior of the helmet toward the rear portion of the helmet. The second extension portion is configured to enclose second circuitry which is electrically coupled to a first set of electrical contacts disposed on the second ear bracket and a second of electrical contacts disposed on a distal end of the second extension portion. An electrical hot shoe mounting member is disposed on the rear portion of the helmet and positioned intermediate the distal end of the first extension portion and the distal end of the second extension portion. The electrical hot shoe mounting member is configured for electrical communication with a power and data circuit associated with the helmet. A hot shoe adapter bridge is configured to be detachably and electrically coupled to the electrical hot shoe mounting member, the hot shoe adapter bridge operable to couple first and second ear brackets to the power and data circuit associated with the helmet.

In a more limited aspect, a helmet accessory system is provided to supply power, manage data, and to control helmet and helmet accessory functions. A cable cover/strap extends between a front shroud and a rear battery mounting bracket for routing power, data, and control signals to attached devices. An identification friend of foe (IFF) marking strobe or beacon is secured beneath the cable cover/strap along the centerline of the helmet. A hot shoe adapter is attachable to the rear battery mounting bracket provide a bridge for coupling left and right side shrouds to the power, data and control signals circuitry. The components can be attached to the helmet using attachment holes located on the helmet. In embodiments, the system is designed to accommodate different sized helmets. Modular headlamps are removably attached to the side shrouds which can be upgraded as illumination technology evolves.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT(S)

Figure 1:
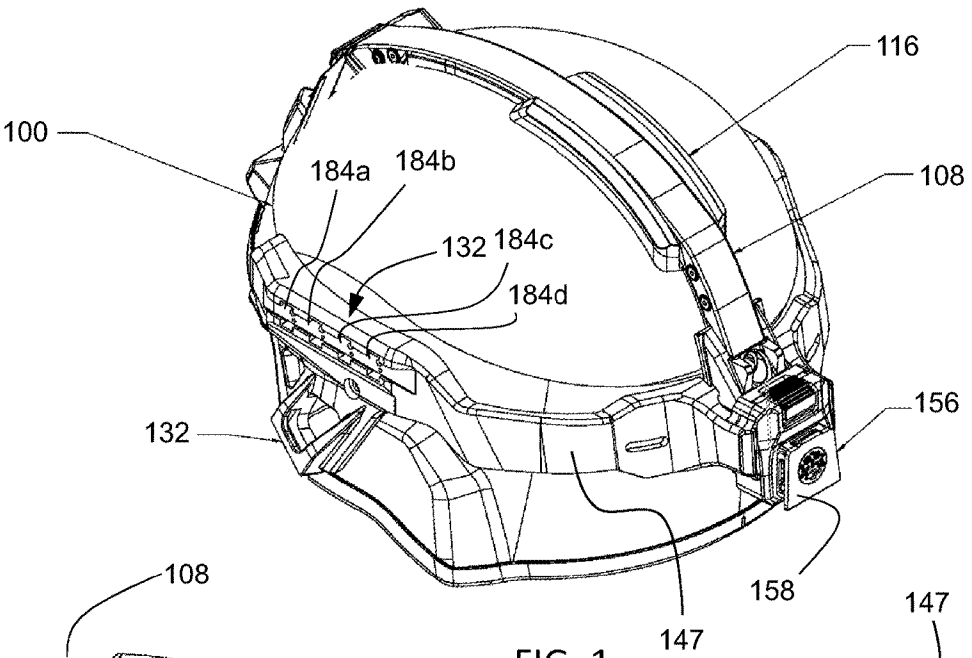
FIG. 1 is an isometric view of a helmet accessory system in accordance with an exemplary embodiment of the invention, taken generally from above, the rear, and the left side.
Figure 3:
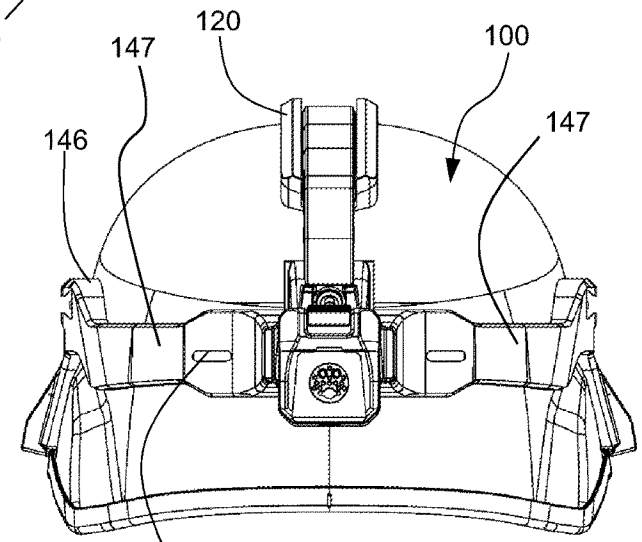
FIG. 3 is a rear view of the helmet accessory system in FIG. 1
Figure 2:
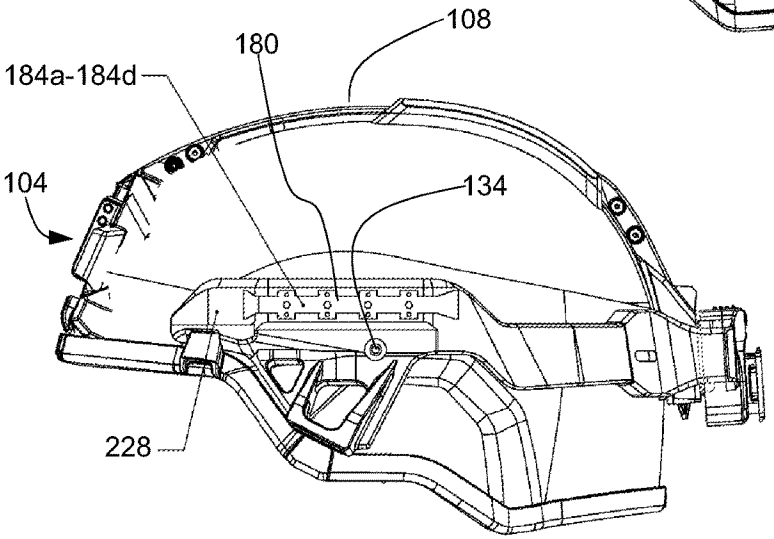
FIG. 2 is a left side view of the helmet accessory system appearing in FIG. 1.
Figure 4:
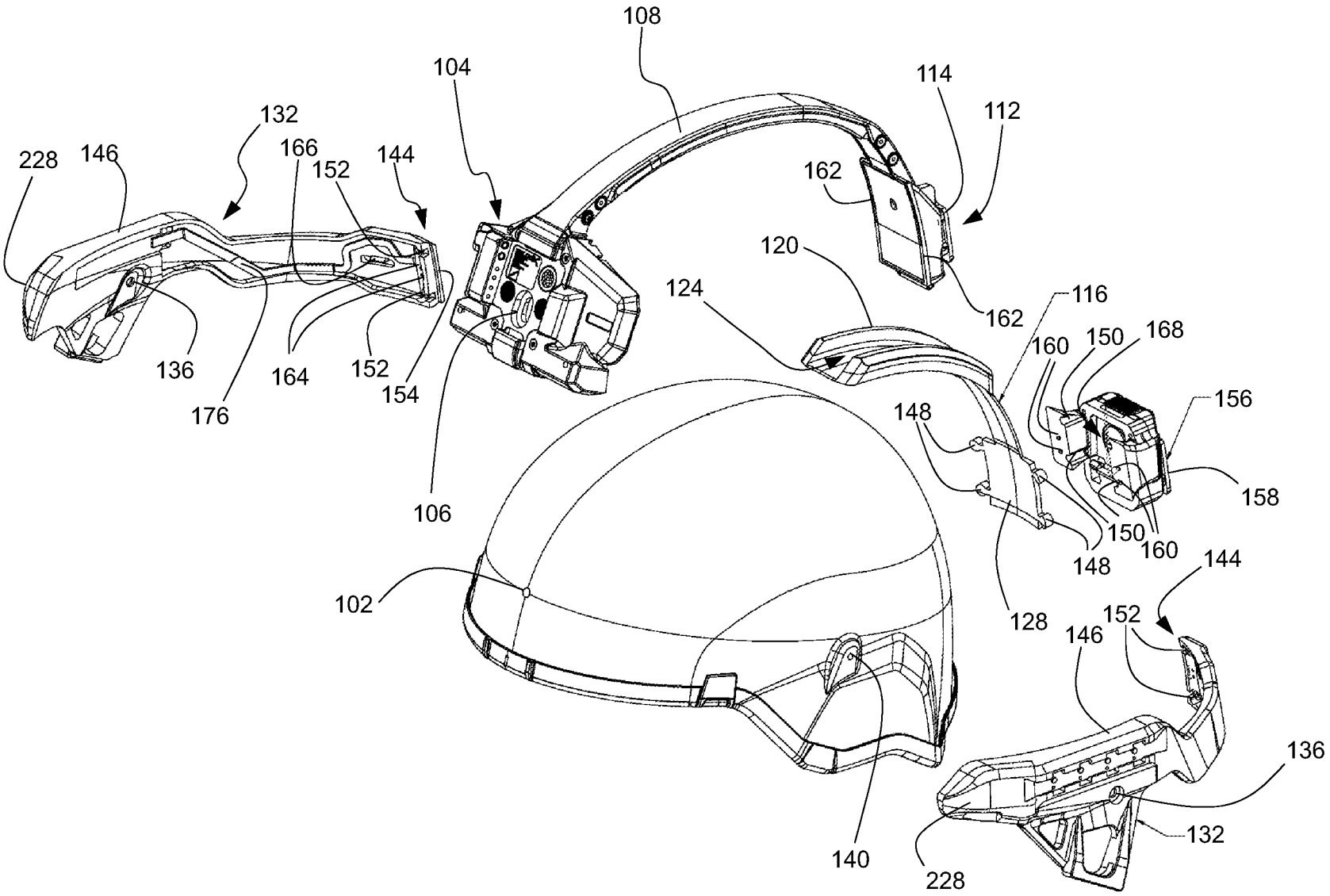
FIG. 4 is an exploded isometric view of the helmet accessory system appearing in FIG. 1.

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Referring now to FIGS. 1-4, there appears a military combat helmet 100 having an exemplary helmet mounting assembly attached thereto. While the illustrated embodiment is configured for use with an Integrated Head Protection System (IHPS) helmet, it will be recognized that the present development could be adapted for use with all manner of protective helmets, including the Modular Integrated Communications Helmet (MICH), Advanced Combat Helmet (ACH), Enhanced Combat Helmet (ECH), and so forth.

A front shroud 104 is attached to the front of the helmet 100. The front shroud 104 is configured to removably attach a helmet accessory mount (not shown) for attaching viewing device (not shown), such as a night vision device or other optical or electro-optical device, camera, display, or the like. In certain embodiments, the front shroud 104 is configured for releasably attaching a mount available from Wilcox Industries Corp. of Newington, NH, such as the Wilcox G24 Mount, L4 G24 Mount, among others. A threaded fastener (not shown) passes through a clearance opening 106 in the front shroud 104 and threadably engages a tapped screw hole 102 in the front of the helmet 100.

A strap or cable cover 108 extends along a centerline of the helmet 100 from the front shroud 104 to an electrical hot shoe mounting member or rear battery mounting bracket 112, disposed at the rear of the helmet 100. The battery mounting bracket 112 includes a hot shoe style interface 114. The front shroud 104, strap or cable cover 108, and battery bracket 112 may be as described in commonly-owned U.S. Pat. No. 10,886,646 or commonly-owned U.S. Pat. No. 11,360,309, each of which is incorporated herein by reference in its entirety.

An identification friend or foe (IFF) module 116 includes a plurality of light emitters which outputs an IFF marking strobe or beacon, which may be infrared (IR), visible, ultraviolet (UV), or a combination thereof. The emitters are housed in a housing 120 having a groove or channel 124. The groove of channel 124 receive the strap or cable cover 108, which secures the IFF module 116 in position on the helmet 100. The IFF module 116 further includes an electrical connector portion 128 which is disposed intermediate the helmet 100 and the battery mounting bracket 112. The electrical connector portion 128 provides an electrical connection between a power supply attached to the battery mount bracket 112 and IFF module 116. The configuration of the IFF housing 120 provides a very low profile on the helmet and reduces the potential for snagging. In embodiments, operation of the IFF module 116 is controlled by an attached controller such as the central network controller 208 (see FIGS. 18 and 19).

In embodiments, the IFF module 116 includes an optical receiver for sensing a laser signal to query the IFF module to determine whether the wearer is a friend or foe.

Left and right shrouds 132 are attached to the respective left and right sides of the helmet 100 via a threaded fastener 134 engaging a clearance opening 136 in the shrouds 132 and engaging a threaded opening 140 in the helmet 100, as well as threaded fasteners 170 (see FIG. 9) which pass through clearance openings 166 near a proximal end 144 of the side shrouds 132 engaging an aligned tapped opening at the rear of the helmet 100. The proximal end 144 of the side shrouds 132 engages the electrical connector 128 as will be discussed in greater detail below. A mechanical coupling is provided via tabs 148 on the connector 128 which engage complementary channels 150 in the base of the hot shoe adapter 156. A housing extension 147 extends between the shroud housing 146 and the side shroud proximal end 144.

A hot shoe adapter 156 includes electrical contacts 160 which engage aligned contacts 164 on the side shrouds 132 to provide an electrical coupling with the side shrouds 132 via circuitry within the shroud housing 146. The hot shoe adapter provides a bridge to connect the left and right side shrouds 132. The hot shoe adapter 156 further includes electrical contacts 168 which engage aligned contacts on the battery mount bracket 112 to provide an electrical coupling between the rear battery mount 112 and the front shroud 104 via circuitry within the strap/cable cover 108.

Figure 5:
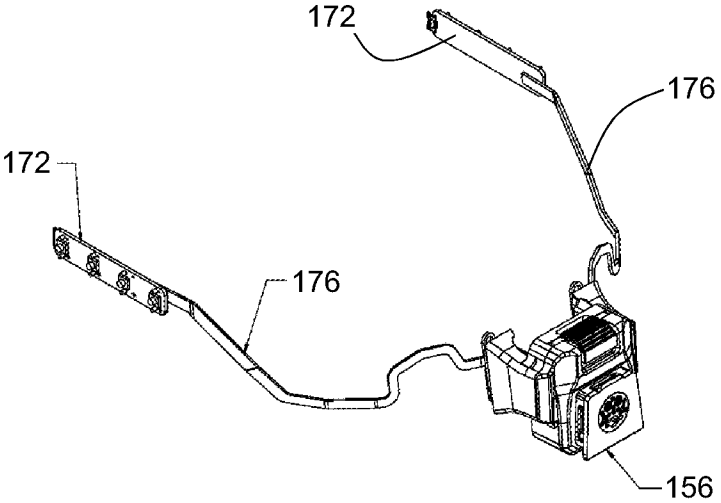
FIG. 5 is an isometric view illustrating the electrical connection between the hot shoe adapter and the power interface boards.
Figure 6:
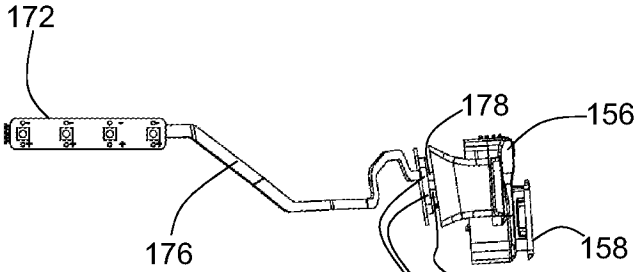
FIG. 6 is a side view of the electrical system appearing in FIG. 5.
Figure 7:
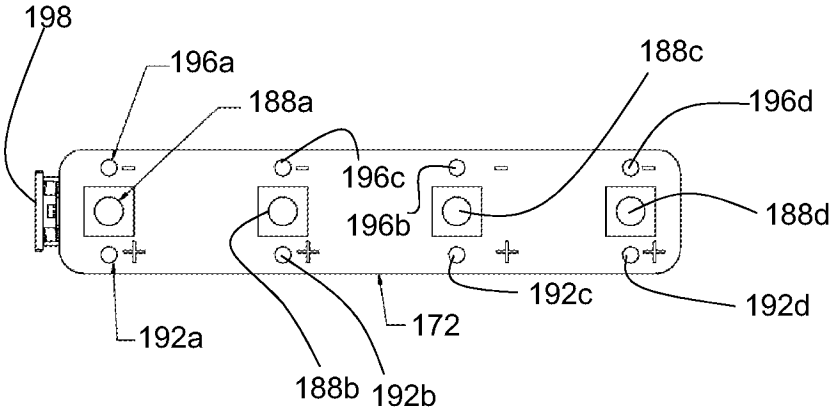
FIG. 7 is an enlarged plan view of the electrical interface board.

Referring now to FIGS. 5-7 and with continued reference to FIGS. 1-4, each side shroud 132 includes a powered interface circuit board 172. Power to the powered interface board is provided via the hot shoe adapter 156 and the contacts 160 and 164. A flex circuit 176 comprising circuit components on a flexible film substrate extends within the housing 146 and the housing extension portion 147 between the contacts 164 and the powered interface circuit board 172.

The side shroud includes a powered rail and data interface portion 180 which has multiple attachment positions (four in the illustrated embodiment) 184*a*, 184*b*, 184*c*, and 184*d*. In embodiments, the powered rail and data interface 180 is a sliding dovetail interface for sliding an accessory device to a desired one of the attachment positions. Each attachment position 184*a*-184*d* includes an aligned push button switch 188*a*-188*d* in electrical communication with respective positive contact pads 192*a*-192*d* and negative contact pads 196*a*-196*d*. The push button switches 184*a*-184*d* are normally open, momentary contact switches. When a powered accessory device is coupled to a given attachment position, the accessory device depresses the associated push button switch to close the circuit between the respective positive and negative contact pads. In this manner, the power interface board 172 distributes power only to the contact pads in use. An electrical connector 198 is disposed at a rearward end of the interface board 172 for distributing power to an LED headlamp module as described below. It will be recognized that the electrical switch and contact configurations illustrated herein are exemplary and illustrative only and configurations having additional or fewer combinations of push button switches and positive and negative contact pads are also contemplated.

Figure 8:
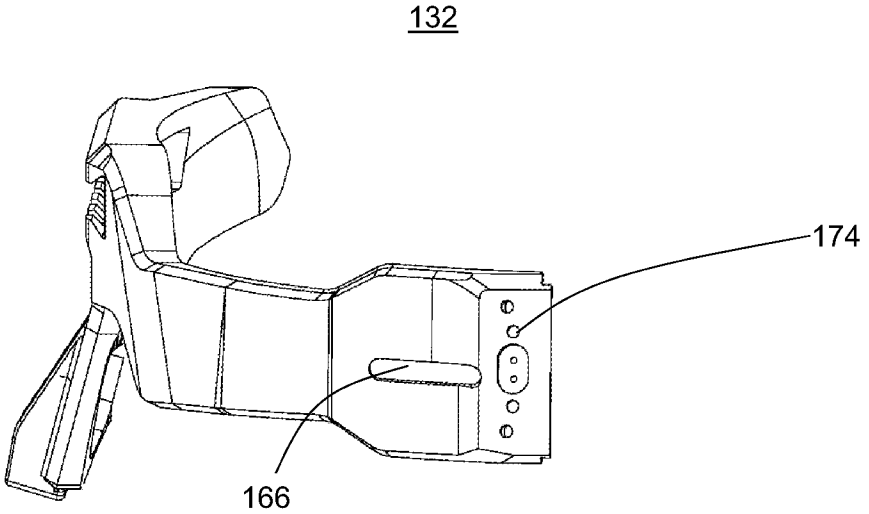
FIG. 8 is an isometric view of a side shroud illustrating the electrical contacts on the proximal end.

Referring now to FIG. 8 and with continued reference to FIGS. 1-7, there appears a left side shroud 132, illustrating the proximal end 144 and the electrical contacts 174 which engage aligned contacts 178 (see FIG. 10) on the hot shoe adapter 156.

Figure 9:
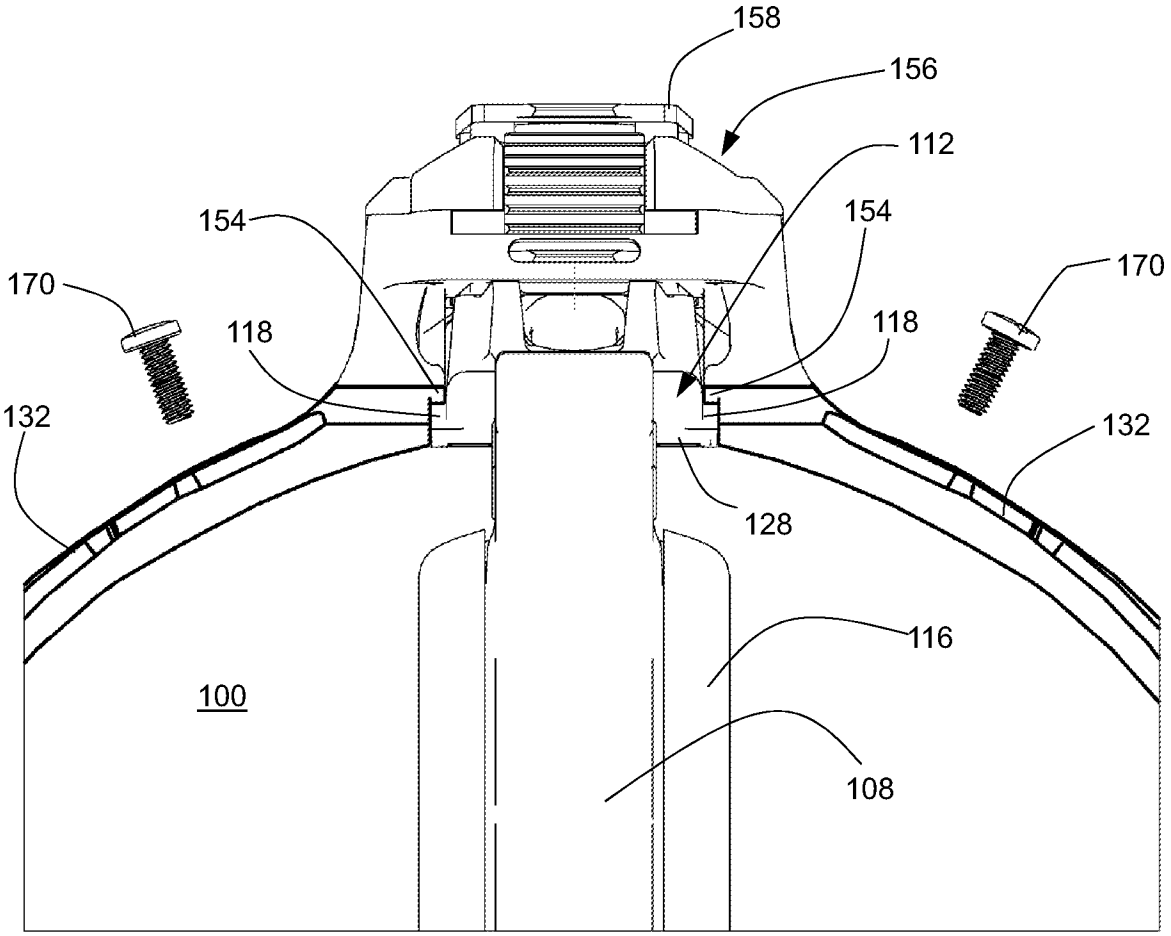
FIG. 9 is a fragmentary top view illustrating the connections between the rear battery bracket, side shrouds, and the hot shoe adapter.
Figure 10:
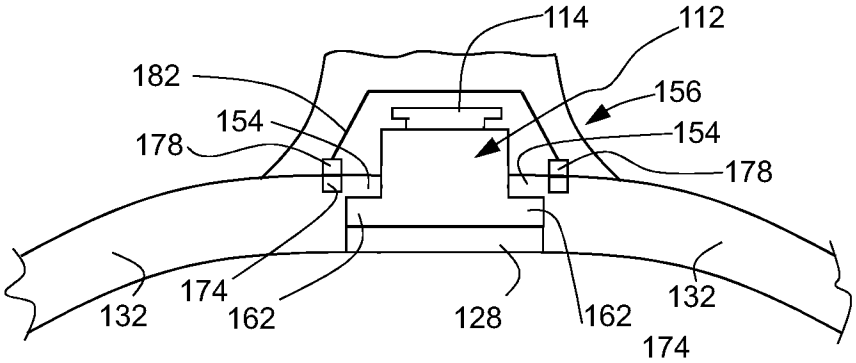
FIG. 10 is a highly schematic view illustrating the connections between the rear battery bracket, side shrouds, and the hot shoe adapter providing a bridge between the left and right side shrouds.

Referring now to FIGS. 9 and 10, and with continued reference to FIGS. 1-8, the proximal end 144 of each side shroud 132 includes a lip 154 which engages a complementary lip or side flange 118 on the battery mount bracket 112. A plurality of contacts 174 on the flex board 176 engage aligned contacts 178 on the hot shoe adapter 156. Circuitry 182 within the hot shoe adapter 156 provides a bridge operable to couple the left and rights side shrouds 132 to each other and as well as to one or more components in communication with the battery mount bracket 112. A threaded fastener 170 passes through a clearance opening 166 in each side shroud 132 and threadably engages a tapped opening (not shown) in the rear of the helmet 100.

Figure 11:
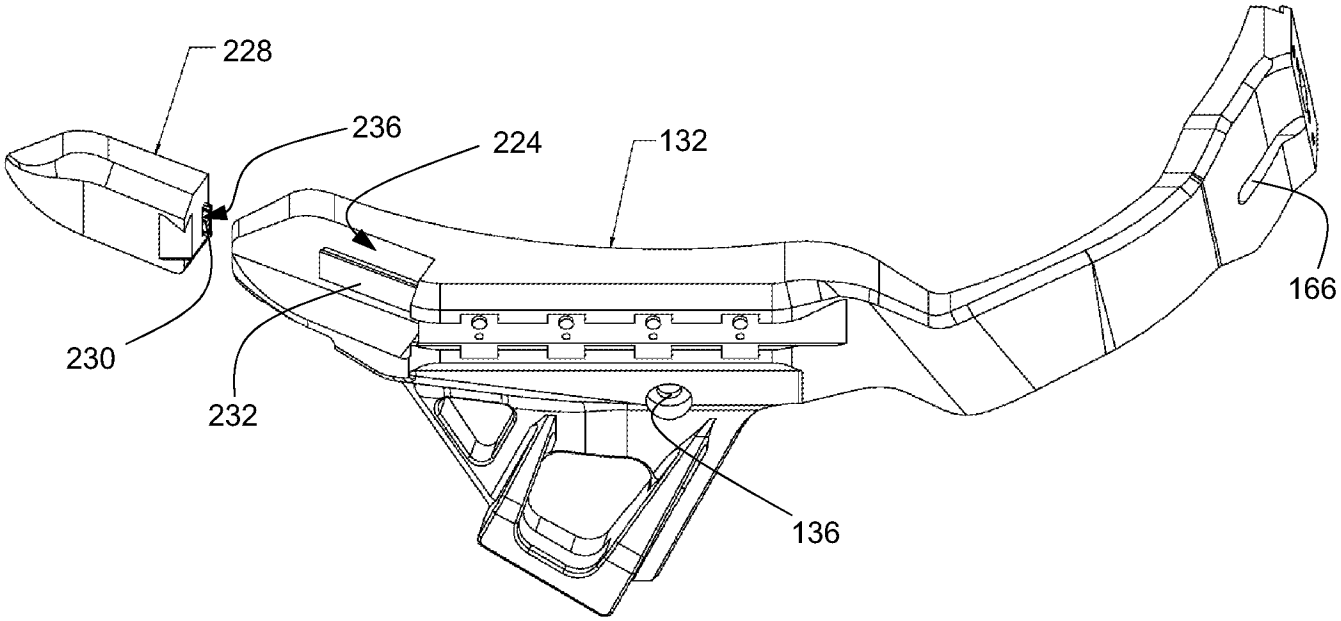
FIG. 11 is an enlarged view of a side shroud with swappable flashlight module.

Referring now to FIG. 11, and with continued reference to FIGS. 1-10, there is illustrated an enlarged side view of the left side shroud 132. The side shroud housing 146 includes a recess 224 removably receiving a modular flashlight 228. The recess 224 includes a rail fastener 232 (e.g., having a T-shaped cross-section or dovetail shaped cross-section), which is slidably received within a complementary elongate channel 236 in the flashlight module 228. The module 228 includes electrical contacts 230 which engage aligned contacts or pins on the shroud 132 to electrically couple the LED module 228 to the power interface board 172 when it fully seated in the recess 224.

Figure 19:
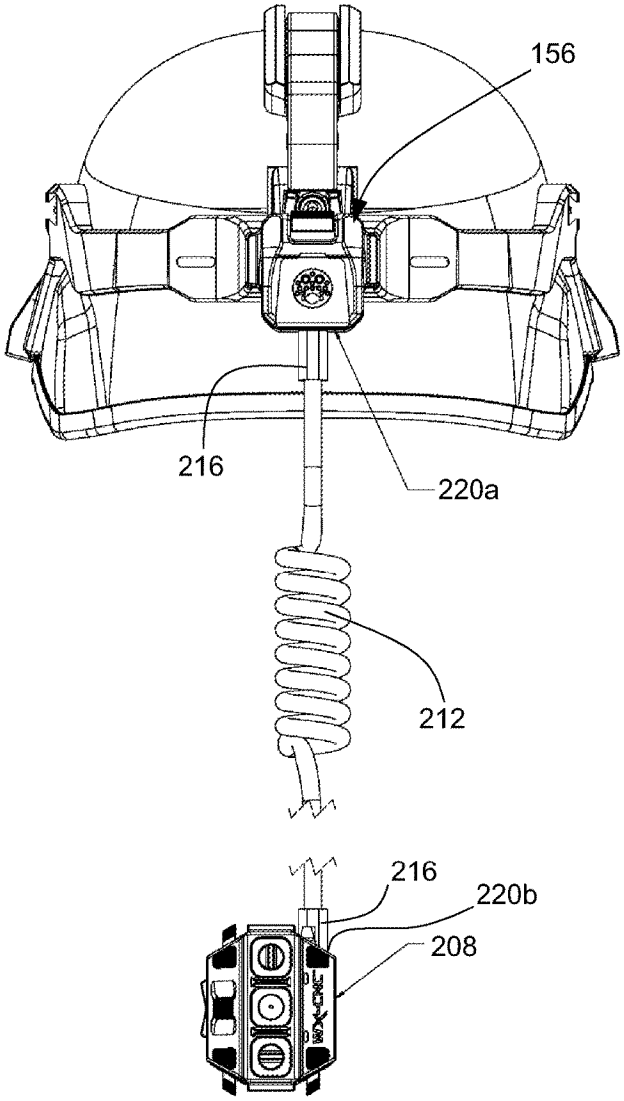
FIG. 19 is a rear view of the helmet accessory system as shown in FIG. 18 with the Wilcox battery pack removed.
Figure 18:
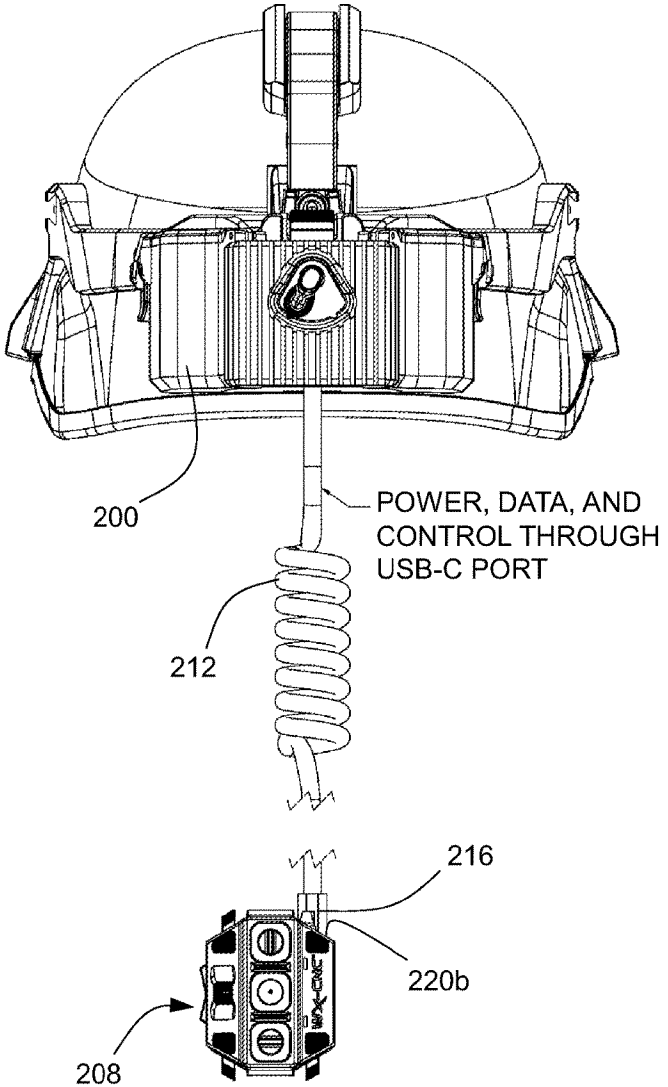
FIG. 18 is a rear view of the helmet accessory system as shown in FIGS. 12 and 13 with an attached central network controller.

The system provides right and left headlights 228. In embodiments, the flashlight modules 228 include visible emitters, IR emitters, multi-color emitters, off-band emitters, or combinations thereof. In embodiments, the flashlight modules 228 are hot swappable to allow users to upgrade or change light configurations. For example, a user may choose to have two visible LED modules 228, 2 IR LED modules 228, or one of each. In certain embodiments, the LED modules 228 may having emitters that emit at different wavelengths, e.g., visible and IR, wherein the mode is selected by the user, e.g., via the network controller 208 or other interface such as an app on a wired or wirelessly attached mobile device. The headlamps 228 are powered and controlled through the ear brackets 132 to a back-connected central network controller 209 as shown in FIGS. 18 and 19 below.

Figure 12:
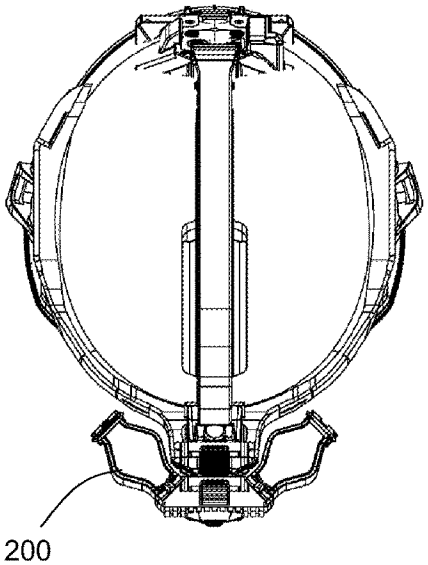
FIG. 12 is a top plan view of the helmet accessory system appearing in FIG. 1 with a hot shoe adapter and Wilcox battery pack attached to the rear mount.
Figure 13:
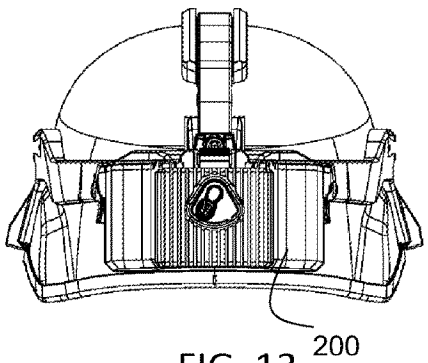
FIG. 13 is a rear view of the helmet accessory system and rear attachments appearing in FIG. 12.

Referring now to FIGS. 12 and 13, and with continued reference to FIGS. 1-11, there appears a first configuration of the helmet accessory system herein wherein the hot shoe adapter 156 is attached to the battery interface shoe 114 and a Wilcox battery pack 200 is, in turn, attached to the hot shoe adapter 156. The Wilcox battery pack may be of the type described in commonly-owned U.S. Pat. No. 10,557,687, the entire contents of which are incorporated herein by reference in its entirety.

Figure 14:
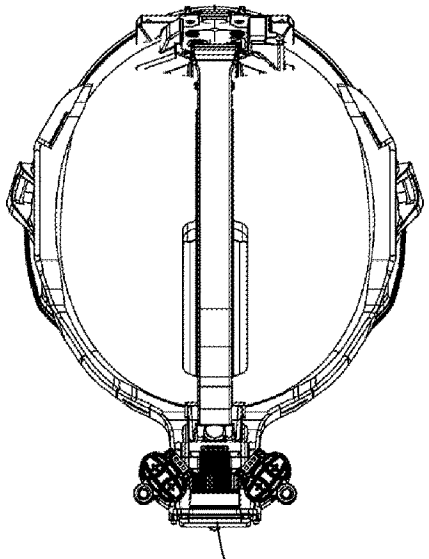
FIG. 14 is a top plan view of the helmet accessory system appearing in FIG. 1 with a hot shoe adapter and Harris L3 or Elbit battery pack attached to the rear mount.
Figure 15:
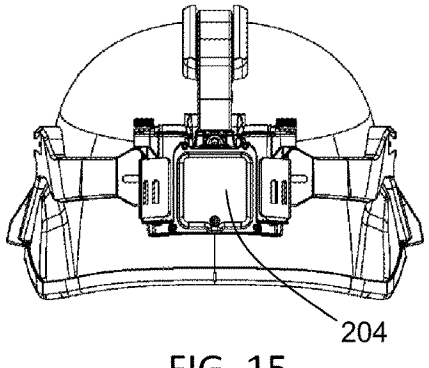
FIG. 15 is a rear view of the helmet accessory system and rear attachments appearing in FIG. 14.

Referring now to FIGS. 14 and 15, and with continued reference to FIGS. 1-13, there appears a second configuration of the helmet accessory system herein wherein the hot shoe adapter 156 is attached to the battery interface shoe 114 and an Elbit battery pack or Harris L3 battery pack 204 is, in turn, attached to the hot shoe adapter 156.

Figure 16:
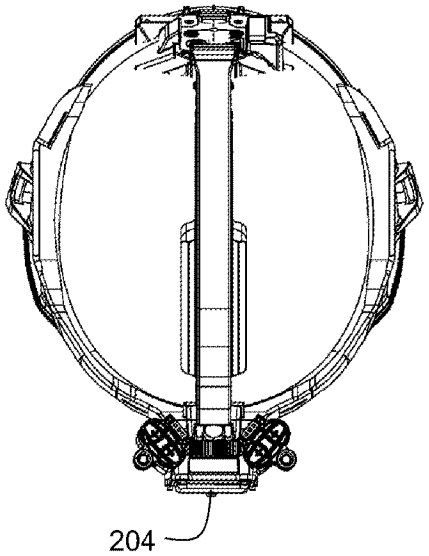
FIG. 16 is a top plan view of the helmet accessory system appearing in FIG. 1 with the hot shoe adapter removed and Harris L3 or Elbit battery pack attached directly to the rear mount.
Figure 17:
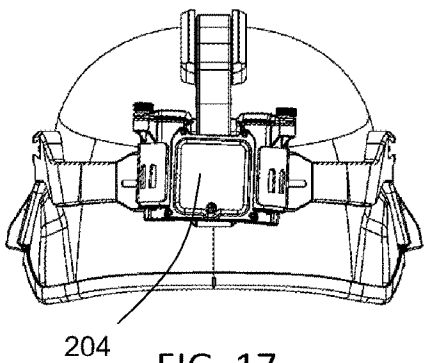
FIG. 17 is a rear view of the helmet accessory system and rear attachments appearing in FIG. 16.

Referring now to FIGS. 16 and 17, and with continued reference to FIGS. 1-15, there appears a third configuration of the helmet accessory system herein wherein the hot shoe adapter 156 is omitted and an Elbit battery pack (e.g., ENVG-B battery box) or Harris L3 battery pack 204 is attached directly to the battery interface shoe 114.

In embodiments, the hot shoe adapter 156 is configured to couple to a battery pack having smart battery technology (i.e., intelligent control and monitoring features) and/or power management features for optimizing energy usage, monitoring battery health, providing state-of-charge (SOC) estimation, balancing charging and discharging of individual battery modules, preventing over-charging or over-discharging, and monitoring thermal issues that can degrade battery performance, and so forth.

Referring now to FIG. 18 with continued reference to FIGS. 1-17, there is shown the mounting system appearing in FIGS. 8 and 9, wherein the Wilcox battery pack 200 is attached to the mounting shoe 158 of the hot shoe adapter 156. Referring now to FIG. 19 with continued reference to FIGS. 1-18, the system appearing in FIG. 18 appears with the Wilcox battery pack 200 removed. The adapter 156, in turn, is coupled to a central network controller module 208 via connector cable 212. The cable 212 is preferably a USB-C cable having locking connectors ends 216. The connector ends 216 engage complementary connector sockets **220*a*, 220*b* on the network controller module 208 and the hot shoe adapter 156, respectively. In embodiments, the network controller module 208, locking connector ends 216, and connector sockets 220*a*, 220*b* are as described in commonly-owned U.S. provisional application Ser. No. 63/423,324 filed on Nov. 7, 2022, which is incorporated herein by reference in its entirety. In preferred embodiments, the connector socket 220*a* points downward to facilitate connection to the network controller module 208. The network controller module 208** may be attached to a weapon carrier by the user or worn on a garment or other equipment worn by the user.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

REFERENCE NUMBER LIST

100 Helmet
102 Front helmet screw hole
104 Front shroud
106 Clearance opening in front shroud
108 Strap/cable cover
112 Battery mount bracket
114 Battery interface shoe
116 IFF module
118 lip/flange on battery mount bracket
120 IFF housing
124 Channel in IFF housing receiving strap/cable cover 108
128 IFF electrical connector
132 Side shrouds
134 Threaded fastener
136 Clearance opening in side shroud
140 Threaded opening in helmet
144 Side shroud proximal end
146 Side shroud housing

147 Side shroud housing extension
148 Tabs on IFF electrical connector
150 receptacles in 156 receiving IFF tabs 148
152 Openings on side shroud proximal end
154 lip/overhang on side shroud proximal end
156 Hot shoe adapter
158 Mounting shoe on 156
160 Hot shoe contacts to side shroud
162 lips or side flanges on base of 112
164 Contacts on side shroud
166 Clearance opening in side shrouds
168 Hot shoe contacts to front shroud
170 Threaded fasteners securing side shrouds
172 Power interface board
174 Contacts on flex board
176 Flex circuit
178 Contacts on hot shoe adapter
180 Powered rail and data interface
182 bridge circuitry in hot shoe adaptor
184*a*-184*d* Attachment positions on 180
188*a*-188*d* Push button switch
192*a*-192*d* + contact pads
196*a*-196*d* – contact pads
198 Electrical connector on power interface board
200 Wilcox battery pack
204 Elbit/L #battery pack
208 WX CNC
212 Cable
216 Locking connector ends
220*a* Locking connector socket on WX CNC
220*b* Locking connector on hot shoe adapter 156
224 LED module recess in side shroud housing
228 LED module
230 Electrical contacts on LED module
232 Slide rail fastener
236 Channel receiving slide rail

What is claimed is:

1. A modular helmet accessory system comprising:

a first ear bracket configured for attachment to a first side of a helmet and a second ear bracket configured for attachment to a second side of the helmet opposite the first side of the helmet;

the first ear bracket having a first side shroud housing configured to be secured to the first side of the helmet and a first extension portion configured to curve around an exterior of the helmet toward a rear portion of the helmet, the first extension portion configured to enclose first circuitry which is electrically coupled to a first set of electrical contacts disposed on the first ear bracket and a second of electrical contacts disposed on a distal end of the first extension portion;

the second ear bracket having a second side shroud housing configured to be secured to the second side of the helmet and a second extension portion configured to curve around the exterior of the helmet toward the rear portion of the helmet, the second extension portion configured to enclose second circuitry which is electrically coupled to a first set of electrical contacts disposed on the second ear bracket and a second of electrical contacts disposed on a distal end of the second extension portion;

an electrical hot shoe mounting member disposed on the rear portion of the helmet and positioned intermediate the distal end of the first extension portion and the distal end of the second extension portion, the electrical hot shoe mounting member configured for electrical communication with a power and data circuit associated with the helmet; and a hot shoe adapter bridge configured to be detachably and electrically coupled to the electrical hot shoe mounting member, the hot shoe adapter bridge operable to couple first and second ear brackets to the power and data circuit associated with the helmet.

2. The modular helmet accessory system of claim 1, wherein the hot shoe adapter bridge comprises an interface connector configured to establish an electrical connection between the hot shoe adapter bridge and a computer-based information handling system.

3. The modular helmet accessory system of claim 2, wherein the interface connector is a USB-C connector socket.

4. The modular helmet accessory system of claim 3, wherein the USB-C connector socket is downward facing.

5. The modular helmet accessory system of claim 2, wherein the USB-C connector socket is downward facing.

6. The modular helmet accessory system of claim 2, wherein the interface connector configured to establish an electrical connection between the hot shoe adapter bridge and a computer-based information handling system which is selected from the group consisting of a computer-based information handling system worn on the body of a user and a computer-based information handling system mounted to a weapon.

7. The modular helmet accessory system of claim 1, wherein the hot shoe adapter bridge is configured to establish an electrical connection to a helmet-mounted identification friend foe (IFF) emitter.

8. The modular helmet accessory system of claim 1, wherein each of the first ear bracket and second ear bracket are configured to be positioned above an ear of a user.

9. The modular helmet accessory system of claim 8, wherein each of the first ear bracket and second ear bracket are configured to attach an accessory device selected from the group consisting of ear pieces, communication headsets, and hearing protectors.

10. The modular helmet accessory system of claim 1, wherein each of the first ear bracket and second ear bracket include a headlamp in electrical communication with the hot shoe adapter bridge.

11. The modular helmet accessory system of claim 10, wherein the headlamp is modular and replaceable.

12. The modular helmet accessory system of claim 1, further comprising a power supply detachably coupled to the hot shoe adapter bridge.

13. The modular helmet accessory system of claim 12, wherein the power supply includes interchangeable battery modules.

14. The modular helmet accessory system of claim 12, wherein the power supply comprises one or both of power management features and intelligent control and monitoring features.

15. The modular helmet accessory system of claim 1, further comprising:

a front shroud;

a cable cover extending between the front shroud and between and the electrical hot shoe mounting member; and circuitry within the cable cover for routing power, data, and control signals to one or more attached accessory devices.

* * * * *